United States Patent [19]

Johnson et al.

[11] 4,025,774

[45] May 24, 1977

[54] TIMING APPARATUS INCLUDING ELECTRONIC CALCULATOR CIRCUITS

[75] Inventors: Clifford C. Johnson, Wheeling; Vincent E. Eitzen, Evanston, both of Ill.

[73] Assignee: American Hospital Supply Corporation, Evanston, Ill.

[22] Filed: June 16, 1975

[21] Appl. No.: 587,356

[52] U.S. Cl. ..... 235/168; 58/23 R

[51] Int. Cl.[2] ..... G04C 3/00

[58] Field of Search ..... 235/168; 58/23 R, 23 AC, 58/24 A, 74, 152 R, 152 B

[56] References Cited

UNITED STATES PATENTS

| | | | |
|---|---|---|---|
| 3,788,058 | 1/1974 | Idei et al. | 58/23 R |
| 3,798,428 | 3/1974 | Izawa | 235/168 |
| 3,816,730 | 6/1974 | Yamamoto | 58/152 R X |
| 3,822,547 | 7/1974 | Fujita | 58/152 B |
| 3,854,277 | 12/1974 | Samejima | 58/152 R X |
| 3,867,619 | 2/1975 | Arauchi | 58/152 R X |

*Primary Examiner*—David H. Malzahn
*Attorney, Agent, or Firm*—Tilton, Fallon, Lungmus, Chestnut & Hill

[57] ABSTRACT

An electronic system employs a calculator as an arithmetic unit and accumulator. A mode switch enables operation as a timer (decrementing from a preset value) or a stopclock (incrementing time). Initial or preset values of time are entered manually through a keyboard in either mode. Sequencing circuitry controls execution of the arithmetic functions of the calculator in proper order and function, depending on the selected mode. The sequencing circuitry also gates the output of an oscillator to provide time increment pulses. A display unit generates a visual display of the accumulated time in both modes. In the timer mode, sensing circuitry senses when a preset time has elapsed and generates an audible signal.

15 Claims, 2 Drawing Figures

CALCULATOR
DIGIT DRIVER
BILATERAL SWITCH

PLUS
ENTER "ONE"
PLUS OR MINUS
voltage
time

TIMING APPARATUS INCLUDING ELECTRONIC CALCULATOR CIRCUITS

BACKGROUND AND SUMMARY

The present invention relates to electronic timing circuitry; and more particularly, to an electronic system capable of operating either as a timer (that is, decrementing time from a preset value) or a stopclock (that is, incrementing time, usually from zero). The stopclock mode is sometimes referred to as an elapsed time mode.

Briefly, the present invention uses a conventional circuit of the type used in electronic calculators to perform arithmetic and logical operations; hence it is referred to as a "calculator". It may include an input register for receiving and storing data temporarily and output registers which serve as accumulators for subsequently displaying either the preset time or the elapsed or remaining time (depending upon the mode). The outputs are displayed by means of Light Emitting Diode Arrays which are also conventional.

A keyboard enables an operator to enter a predetermined value of time into the calculator. A mode switch determines whether the system will operate in the timer mode or the stopclock mode. In the timer mode, an indication is given when a preset time has elapsed. The operation enters the preset time by means of the keyboard into the calculator, with the mode switch in the timer position. Next, the operator presses a "START/-STOP" switch; the first actuation of the START/STOP switch causes the sequencing circuitry to begin operation. A subsequent actuation of the START/STOP switch will cause the timer to stop.

In the timer mode, the sequencing circuitry first effects an addition function which enters a preset time value. Next, the sequencing circuitry enters the value 1 which serves as the future decrement value. Next, the sequencing circuitry enables the passage of an output train of pulses from an accurate oscillator circuit, each pulse effecting a subtraction function to thereby decrement the preset time value accordingly until the preset time has elapsed. The system continues to decrement the time value into negative numbers to indicate elapsed time beyond expiration of the preset time.

Sensing circuitry senses the presence of a minus sign from the calculator in the "tenths" digit position, and generates an audio signal to alert the user. The START/STOP switch enables the user to both start and stop the system by triggering a latching circuit to change states upon successive closures of the switch.

In the stopclock mode, the system gives the user the capability of entering a preset time, although in this mode operation normally begins with zero time, since elapsed time is being measured. When the START/-STOP switch is actuated a first time, the sequencing circuitry effects an addition function in the calculator to load the preset time (or the usual ZERO value if no preset time had been entered by the keyboard) into the calculator. A subsequent pulse from the sequencing circuitry establishes unity as the incrementing value, and thereafter, the sequencing circuitry couples the output of the oscillator to effect the addition function in the calculator to increment the stored value.

The oscillator is designed to generate an output pulse once every one-hundredth of a minute, so the timer has a nominal resolution of 0.01 minute. Since the oscillator has been found to be very accurate, the timing system is correspondingly accurate.

With the present invention, we have been able to provide a highly accurate, yet economical and reliable system, using modern electronic components and techniques developed for the computing arts. Because the system has a calculator and a keyboard, great flexiblity in use is provided. Further, greater accuracy and reliability are provided over conventional mechanical systems of equal costs.

Other features and advantages of the present invention will be apparent to persons skilled in the art from the following detailed description of a preferred embodiment accompanied by the attached drawing.

THE DRAWING

FIG. 1 is a circuit schematic diagram, partly in functional block form, of a system incorporating the present invention; and FIG. 2 is a timing diagram illustrating the various voltages generated by the sequencing circuitry of the system of FIG. 1.

DETAILED DESCRIPTION

Figures 1, 2:
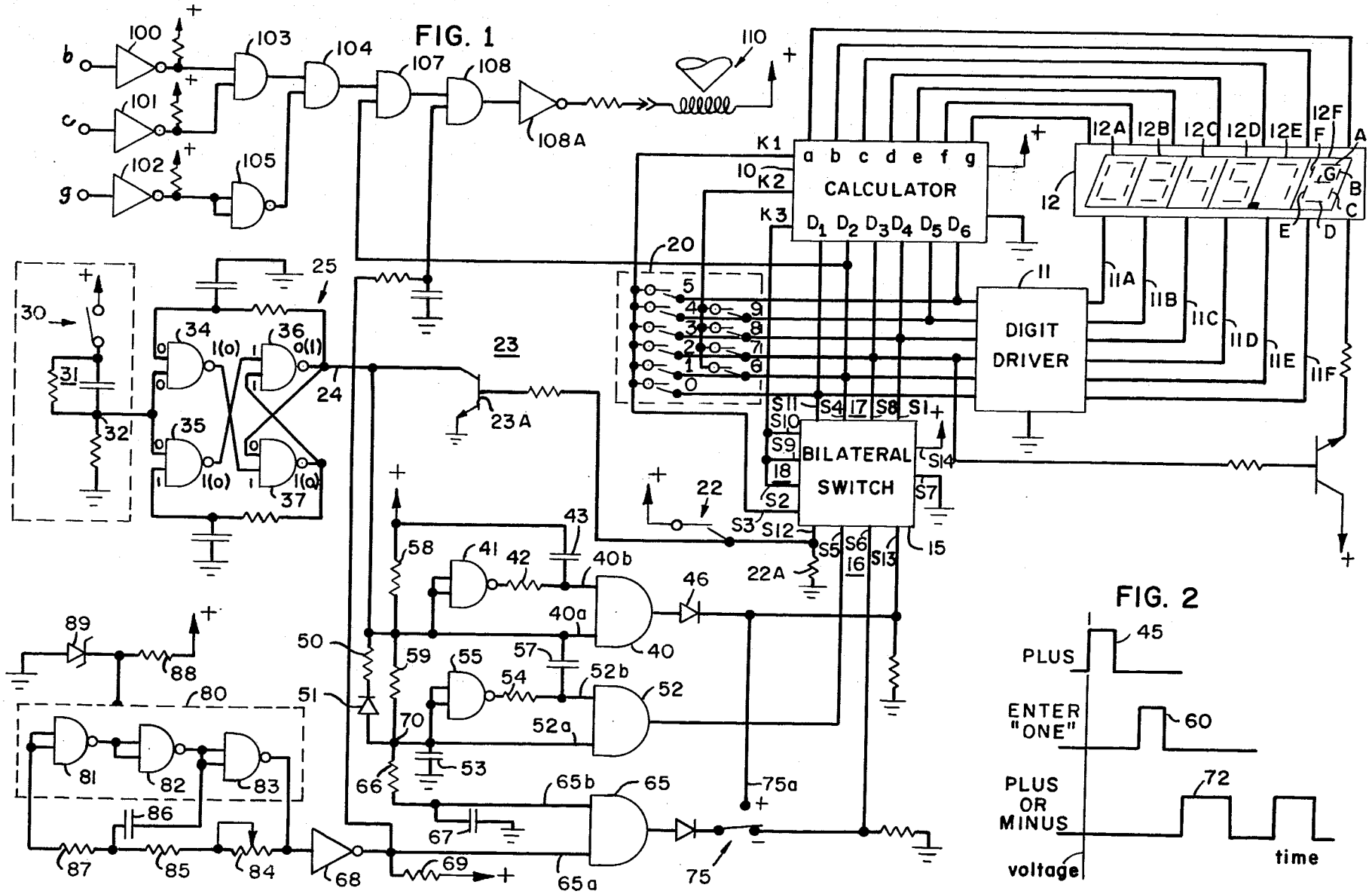

Referring now to FIG. 1, reference numeral 10 generally designates an electronic digital circuit known in the art as a calculator circuit. Such circuits are well known in the art, and briefly, they comprise an integrated circuit which is capable of receiving electrical signals in binary form representing data, executing predetermined arithmetic or logical operations on the data, and presenting the results at output lines. One such circuit commercially available is sold under the part designation MM 5736, manufactured by National Semiconductor of Santa Clara, Calif.

Output digit select lines of the calculator 10 are designated respectively $D_1$ through $D_6$; and they are coupled to a Digit Driver generally designated 11 which, in turn, drives a Light-Emitting Diode Display (LED Display) generally designated 12. The Digit Driver is simply an amplifier switch for each line, and it may be National Semiconductor Part No. DM 75492. The LED Display 12 may be National Semiconductor Part No. NSA 498 or equivalent.

There are seven outputs from the calculator 10 designated respectively *a–g*, and these correspond respectively to the individual line segments of each element of the digit display. In the LED Display 12 of the illustrated embodiment, there are six individual display elements, denoted respectively 12A–12F, in order of decreasing significance—that is, the most significant digit is, as usual, in the far left position and the least significant digit is in the far right position, 12F.

Each element is, of course, capable of displaying any number of alpha-numeric characters, but in this embodiment, each need be capable of displaying only the digits 0 through 9, together with a "–" sign. Referring to the display 12F of the least significant digit, it will be observed that there are seven individual line segments forming the figure "8", and these are designated respectively A through G.

A particular digit element is selected by means of time-division multiplexing. That is, the output digit select lines D1–D6 of the calculator correspond respectively to the display elements 12A–12F of the LED display 12. The Digit Driver 11 has six output lines designated respectively 11A through 11F and also corresponding respectively to the six digit locations 12A through 12F of the LED display 12. Thus, when a signal appears on the output $D_1$ of the calculator, it energizes the digit driver 11 to generate a driving signal on the output line 11F, thereby enabling the least significant digit element 12F of the display to be illuminated. The digital information of the particular alpha-numeric character to be displayed is carried by the output lines *a–g* of the calculator, each line corresponding to a different line segment A–G of a display element. In summary, a signal appears on only one of the digit select lines $D_1$–$D_6$ at a given time to select a display element 12A through 12F; and the corresponding lines *a–g* are selectively energized to generate the required symbol. Segment information is supplied to all digits simultaneously, but only the digit selected displays the information.

During the keyboard entry of data, the calculator will transmit signals to the display so that this information will be displayed. When an addition or subtraction function is performed, the results will be transmitted for display.

The digit select lines $D_1$–$D_4$ of the calculator 10 are coupled directly to four inputs of a bilateral switch generally designated by reference numeral 15. The bilateral switch 15 may be National Semiconductor Part Number MM 5616; and it has four control inputs collectively designated 16, four input signal lines 17, and four output signal lines 18, as shown. The individual control inputs are designated S12, S5, S6 and S13. The individual input signal lines are designated respectively S11, S4, S8 and S1. The individual output signal lines are designated respectively S10, S9, S2 and S3. Table I below shows the relationship between the connections that are made between one of the input lines 17 and one of the output lines 18, as a function of the energization of one of the control lines 16.

TABLE I

| Control | Input | Output | Function |
|---|---|---|---|
| S13 | S1 | S2 | ADDITION |
| S5 | S4 | S3 | ENTER "1" |
| S6 | S8 | S9 | SUBTRACTION |
| S12 | S11 | S10 | CLEAR |

In interpreting Table I, for example, if a signal appears on the control line S6, then the bilateral switch 15 will make a direct connection between input line S8 and output line S9, while isolating all other inputs and outputs.

The function of the bilateral switch 15 is to initiate the selected arithmetic function of the calculator 10. There are three keyboard inputs K1, K2 and K3 to the calculator 10.

The keyboard 20, as illustrated, includes 10 separate digit switches indicated 0 through 9. The switches for digits 0 through 5 have one terminal connected in common and to the input of the calculator designated $K_1$. The other terminals of these switches are connected respectively to the digit select lines $D_1$–$D_6$ of the calculator. The digit switches 6 through 9 of the keyboard 20 have one terminal connected in common and to input K2 of the calculator. The other terminals of each of the digit switches 6 through 9 are connected respectively to the output digit lines $D_2$–$D_5$ of the calculator.

The keyboard 20 also contains another single pole/single throw switch designated by reference numeral 22, and sometimes called "CLEAR" switch. One of its terminals is connected through a resistor 22A to ground; the other terminal is connected to the positive terminal of a power supply. When the CLEAR switch 22 is open, the "output" is at ground, and when it is closed, the output is at a positive voltage level which, in turn, is fed directly to the input terminal designated S12 on the bilateral switch 15. When this line is energized, it couples input S11 to output S10, causing the calculator to clear. The same signal is transmitted to a reset circuit 23, comprising a transistor 23A, the collector of which is connected to a line 24. When the transistor 23A conducts it causes a latching flip-flop, generally designated 25, to reset, as will be more fully discussed below.

SEQUENCING CIRCUITRY

Referring to the central left portion of the drawing, reference numeral 30 generally designates another single pole/single throw switch (sometimes called the START/STOP switch) on the keyboard which, when closed, transmits a voltage level to a differentiator circuit 31, the output of which is a pulse which appears at a junction 32 comprising a trigger input of the latching flip-flop 25. Thus, successive actuations of the switch 30 will cause the latching flip-flop 25 to toggle.

The differentiator circuit 31 (comprising a capacitor and resistor as illustrated) at the input 32 of the flip-flop 25 is important in that only a single pulse must be present at the input of the flip-flop, not a level, otherwise, the flip-flop will become astable and it will be difficult to control the running of the timer. The flip-flop 25 includes four NAND gates (designated respectively 34, 35, 36 and 37), connected in circuit as illustrated. Briefly, in operation, assuming that the flip-flop 25 has been cleared or reset, then the output designated 24 is a 0 (it will be assumed that a 0 is a relatively low voltage). The 1 and 0 states or signals shown without parentheses are after "RESET" and are stable states. When an input pulse occurs at junction 32, the output of the NAND gate 35 will become 0, thereby switching the output of the NAND gate 36 to a 1, as shown in parentheses. This, in turn, will cause the output of the NAND gate 37 to become a 0 since both inputs will be 1. Again, the NAND gates will be in stable states, but the flip-flop will have switched. The resistor-capacitor networks coupling the outputs of the NAND gates 36, 37 to one input each of the NAND gates 34, 35 respectively effect a slight delay in signal transmission to avoid astable operation. In other words, the feedback signal from the output terminals of the second stage of the latch flip-flop 25 is delayed until such time as it is certain that the input pulse has terminated. The START/STOP switch 30 may be used to stop operation by a second actuation which triggers the flip-flop 25 into reset, thereby inhibiting the further transmission of clock pulses to the calculator by rapidly discharging capacitors 53 and 67 through diode 51. The flip-flop 25 may be reset by the reset circuit 23 which causes the input of NAND gate 37 to be a 0, thereby causing the output to be a 1 to maintain the output of gate 36 at 0. The reset circuit 23 is energized when the CLEAR switch 22 is actuated.

As has been explained above, when the STOP/-START switch 30 is closed a first time, a signal level appears on the line 24, and it is coupled directly to an input **40*a* of an AND gate 40. The other input 40*b* of the AND gate 40 is received from an inverter 41 through a resistor 42. This input is also connected through a capacitor 43 to the positive supply level. The input of the inverter 41 is connected to the output 24 of the latch flip-flop 25. Hence, when a 1 occurs on the output 24 of the latch 25, the first input 40***a* of the AND gate 40 is a 1 and, because the capacitor 43 will not permit instantaneous voltage changes, the input 40*b* is also a 1. However, the capacitor 43 begins to charge because the output of the inverter 41 is a 0. Hence, a pulse is generated at the output of the AND gate 40, such as is shown at 45 in FIG. 2. This pulse is coupled through a diode 46 to the control terminal S13 of the bilateral switch 15. The input S1 of the bilateral switch is thus connected directly to output S2. This, in turn, causes a direct connection between the digit location $D_4$ and the input K3 of the calculator, thereby causing the calculator to effect an "ADD" function. It will be appreciated that prior to the actuation of the START/STOP switch 30, the operator may have entered any arbitrary number into the calculator by means of the keyboard 20 so that the entered number will be incremented or decremented when the switch 30 is actuated, as will be explained more fully below. If the operator does not enter a number, it simply means that the incrementing (or decrementing) will begin at zero.

A resistor 50 and a diode 51 are connected as shown between the output line 24 of the latching flip-flop 25 and one input 52*a* of an AND gate 52. The input 52*a* is also connected to ground by means of a capacitor 53. A second input 52*b* of the AND gate 52 is connected by means of a resistor 54 to the output of an inverter 55, the input of which is connected in common with the input 52*a* of the AND gate 52. The input 52*b* is also connected through a capacitor 57 in common with the input 40*a* of the AND gate 40. A resistor 58 is connected between the common line connecting the output 24 of the flip-flop 25 to the input 40*a* and the positive supply.

A resistor 59 is connected across the series circuit comprising resistor 50 and diode 51. The RC time constant formed by the capacitor 53 and the resistor 59 is long enough to insure that the pulse 45 (from Gate 40) has terminated before the AND gate 52 generates a pulse (see pulse 60 in FIG. 2). However, during resetting, the capacitor 53 is discharged through the smaller resistor 50 and diode 51, so that the charge time for the capacitor 53 is longer than the discharge time.

When the charge builds up on capacitor 53 sufficiently, a 1 signal is present on input 52*a* and at the input of inverter 55. However, the input lead 52*b* is temporarily a 1 because of capacitor 57. Hence, the signal on lead 52*b* will go to a 0 as determined by the time constant of capacitor 57 and resistor 54. This defines the width of pulse 60 in FIG. 2. The pulse 60 is coupled to the input S5 of the bilateral switch 15 which, it will be remembered, connects the inputs S4 with the output S3. When this happens, the output $D_2$ of the calculator 10 is connected to the input K1, and this enters a digit 1 into the calculator 10.

To review, the reason the first "+" is actuated, (that is, the ADD function generated by the AND gate 40) is that the operator may already have entered an ADDEND (preset time) through the keyboard 20. If he has not, the first + function enters zero, and the function of the AND gate 52 is to enter the subsequent ADDENDS (namely 1 s) to increment of decrement the partial sum stored in the calculator 10.

A third AND gate is designated 65, and it includes a first input 65*a* and a second input 65*b* which is connected by means of a resistor 66 and the resistor 59 to the output 24 of the flip-flop 25. A capacitor 67 is connected between ground and the junction of resistor 66 and input 65*b* of the AND gate 65. The input 65*a* of the AND gate 65 is connected to the output of an inverter circuit 68 and through a resistor 69 to the positive voltage supply level. The junction denoted 70 (between resistors 66 and 59), it will be recalled, is the same as the input 52*a* of the AND gate 52; and it follows the level signal at the output 24 of the flip-flop 25 after a time delay. Thus, the input 65*b* will follow the voltage at the junction 70, but a still further time delay is added by virtue of the resistor 66 and the capacitor 67.

This time delay is such the the output of the AND gate 65 is a voltage level (see 72 of FIG. 2) which does not become a 1 until the pulse 60 of the AND gate 52 has terminated. The input 65*b*, in effect, acts as an "ENABLE" input of the AND gate 65 and the output will be a series of signals or pulses from an oscillator, as will be discussed. This output train of pulses is coupled through a single pole/double-throw switch 75, one terminal of which (denoted +) is connected to the control input S13 of the bilateral switch 15, and the other terminal of which ( − ) is connected to the control input S6 of the bilateral switch 15. For short, the circuitry associated respectively with AND gates 40, 52, and 65 are sometimes referred to as the first, second and third "channels" of the sequencing circuitry since each generates a signal, all of which are related in time but which perform separate functions.

In the position shown, the switch 75 will cause the timer to decrement because the function called for is subtraction. In the other position, the system will effect an addition, so the timer will be incremented. The former operation (decrementing from a preset time) is most commonly referred to as "timer" operations, and the latter is called a "stopclock" or elapsed time mode. In either mode, operation may be stopped by a second actuation of the STOP/START swithc 30, which triggers the latching flip-flop 25 to reverse states. This, in turn, will disable the AND gate 65 so that no further pulses will be transmitted from the oscillator 80. The resultant time will nevertheless be stored for reference until the CLEAR button 20 is actuated.

At the lower left-hand corner of the drawing is an oscillator circuit generally designated by reference numeral 80 and comprising three series-connected inverters 81, 82 and 83. The output of inverter circuit 83 is connected through a variable resistor 84 and a fixed resistor 85 to one terminal of a capacitor 86, the other terminal of which is connected to the junction between the output of inverter 82 and the input of inverter 83. The junction between the capacitor 86 and resistor 85 is also connected by means of a fixed resistor 87 to the input of the inverter 81. All of the inverter circuits are powered by a voltage which is reduced from the battery voltage powering the remainder of the timer circuitry, this voltage being reduced for greater regulation and accuracy by means of a resistor 88 and a Zener diode 89. Alternatively, a conventional three-terminal voltage regulator may be used.

In other words, the stability of oscillation of the oscillator 80 is enhanced by using a voltage regulating circuit and by using precision temperature-stable resistors 84, 85 and capacitor 86.

In operation, the "T" network comprising resistors 84, 85 and 87 and the capacitor 86 effect a delay in transmission between the output of the inverter 83 and the input of the inverter 81, thereby causing a ring oscillator effect. The duty cycle for the oscillator 80 is preferably about 50 percent. The oscillator 80 generates approximately 100 cycles per minute. The accuracy of the oscillator 80 determines the accuracy of the system because its output decrements the preset time in the timer mode and increments accumulated time in the elapsed time mode. The output of the oscillator, then, is coupled to the signal input 65*a* of AND gate 65 and thence through the switch 75 to the bilateral switch 15. Depending upon the state of the switch 75, the calculator will increment (+) or decrement (−) the number that had been inserted (if one had been inserted by the keyboard) or the starting number 0 (if a number had not been entered into the calculator by the keyboard).

Turning now to the upper left-hand portion of the drawing, circuitry is used to detect a minus sign in the digit location 12E which, if present, will cause an interrupted or modulated tone to be generated to alert the operator that a preset time has expired. The circuitry is sensitive only to the location of the − sign in the digit location 12E, which is the tenths digit if hundredths of minutes are accounted for, as shown. Hence, the modulated tone is present only for approximately one-tenth of a minute after the preset time has elapsed. As soon as the first tenth of the first minute after expiration has terminated, a 1 appears in 12E, the minus sign appears in the digit location 12D, and the tone will stop.

The circuitry just mentioned includes three inverters designated respectively 100, 101 and 102. The output of the inverters 100 and 101 are connected respectively to the inputs of an AND gate 103, the output of which feeds one input of a second AND gate 104. The output of the inverter 102 is fed through a second inverter 105 which feeds the second input of the AND gate 104.

The inputs of the inverters 100, 101 and 102 are connected respectively to the output lines *b*, *c* and *g* of the calculator 10 which define a unique set of signals for indicating the presence of a minus sign (corresponding to segment lines B, C and G of the display element). That is, when segment lines B and C are 0 and segment G is a 1, there is defined a unique set of signals for indicating the presence of a minus sign in the display element. When this occurs, the AND gate 104 will generate a 1 output which is coupled to one input of an AND gate 107, the output of which feeds still another AND gate 108. The other input of the AND gate 107 is received from the digit output line $D_2$ on the calculator 10. It is this signal which generates the audio tone (because of the time division multiplexing mentioned above), and also, when correlated with the segment information fed into the inverters 100–102 insures that the audible signal is present only when the minus sign occurs in the second least significant digit location.

The other input of the AND gate 108 is received from the oscillator 80, and it is this signal which modulates the audio signal—that is, it provides the "bleep" of the audio signal. The output of the AND gate 108 is coupled through an amplifier 108A to a speaker 110 for generating the audio signal.

Summary of Operation

When power if first turned on, random numerals appear on the display. These are eliminated by actuating the CLEAR switch 22. When the CLEAR switch is actuated, the flip-flop 25 is also reset through the inverter 23. Thus, actuation of the CLEAR switch also insures that the flip-flop 25 is in the proper state to begin timing operations.

In the elapsed time or stopclock mode of operation, it is normally desired to begin counting time from zero, although it is possible to pick up elapsed time from a predetermined number by first entering that number into the calculator 10 through the keyboard 20. It is also possible to interrupt the timing and then resume it in either mode.

In the stopclock mode, the switch 75 is turned to the + position, coupling the output of AND gate 65 to the input S13 of the bilateral switch 15. As already mentioned, this causes the input S1 to be connected to the output S2, resulting in a connection between the output $D_4$ of the calculator 10 and the input K3, causing the calculator to execute an addition operation. With the mode switch 75 in the position illustrated, and with either 0 or a preset number in the calculator, and assuming the latching flip-flop 25 had been reset, the operator depresses the START/STOP switch 30, thereby generating a pulse to trigger the flip-flop 25 to the set state. The output signal of flip-flop 25 first causes the AND gate 40 to generate the pulse 45 of FIG. 2, thereby causing the calculator to execute an addition function. This first addition permanently stores the preset number in the calculator 10, the output of which is displayed on the display 12, with suitable decimal notation.

Next, and without further operation by the user, the AND gate 52 generates the pulse 60 which causes the numeral 1 to be entered into the calculator. This numeral then becomes the increment by which the output value is increased when the AND gate 65 is enabled and the pulses from the oscillator 80 cause repeated execution of the ADD function in the calculator to increment the output by 1. The decimal point on the display is permanently located between digit locations 12D and 12E; and since the oscillator 80 generates 100 pulses per minute, the timer is incremented by one-hundredth of a minute for each output pulse of the oscillator 80. Operation is terminated by depressing the START/STOP switch 30. It will be observed that because operation normally starts with the value 0 in the display or some preset positive number, the audio circuitry for energizing the speaker 110 is not operative. That is, its operation is dependent on the detection of a negative sign in the second digit location 12E.

The CLEAR switch 23, when depressed, generates a 1 signal on input S12 of the bilateral switch 15; and as seen on Table I, this will cause digit select line D1 (input S11 on the bilateral switch) to be coupled to input K3 (output S10 of the bilateral) to clear the calculator.

Operation in the timer mode is similar except that a predetermined number is normally entered into the calculator 10 by means of the keyboard 20. In this mode, the mode switch 75 is set to the ( − ) sign position, so that the contents of the calculator 10 are decremented by the value 1 for each output pulse of the oscillator 80. Otherwise the sequencing by means of the AND gates 40, 52 and 65 is similar to that which has already been described. After the contents of the calculator pass through 0, and a negative sign is detected in the tenths position 12E, as described above, the speaker 110 is actuated with an intermittent tone.

Modification for Stopclock Only

If it is desired to use the present system as a stopclock only—that is, to record elapsed time—a number of modifications can be made to simplify the system. Briefly, the circuitry for sensing the presence of the minus sign and for actuating the audible signal can be eliminated. This includes the inverters 100, 101 and 102, the gates 103, 104, 105, 107, 108 and 108A, and the speaker 110. Further, the keyboard 20 can be eliminated as can the analog switch 15. The third channel of the sequencing circuit may also be eliminated, that is, the AND gate 65 and its associated circuitry.

In this modification, the AND gate 52 is changed to a two-input NAND gate, the first input being shown at 52*b*, and the second input 52*a* beng received from the CLEAR switch 22 through an inverter. The NAND gate 55 is changed to a three-input gate, one input of which is received from the junction 70 as illustrated, and a second input of which is received from an oscillator circuit. A third input signal is received from the digit select line D4 of the calculator 10. The output of the NAND gate replacing AND gate 52 is connected directly to the K3 input for causing an ADD function to be performed in the calculator upon each occurrence of an oscillator signal, when the second timing channel is actuated (that is, after the delay of the set pulse from the flip-flop 25 caused by the capacitor 53 and resistor 59, as discussed above). Further, the AND gate 40 is changed to a three-input NAND gate, two inputs of which are connected as shown, and the output of which is fed through an inverter to the K-1 input of the calculator 10 to enter a 1 into the calculator for incrementing the stopclock. The third input of the NAND gate replacing AND gate 40 is received from the D2 digit select line of the calculator 10.

With the modifications just described, the START/-STOP switch 30 again causes the flip-flop 25 to be set, and the first channel to the sequencing circuitry enters a 1 into the calculator 10. A predetermined time after this pulse terminates, the second channel of the sequencing circuitry becomes actuated, and couples the output of the oscillator into the K3 input of the calculator, thereby periodically incrementing the contents of the calculator which, are displayed as before.

The stopclock of this embodiment is stopped by again depressing the START/STOP switch 30, or by actuating the CLEAR switch 22. Again, the primary function of the CLEAR switch 22 is to set the display to zero. Another function is to eliminate the random signals which appear on the display when the unit is turned on, and at the same time, through the reset circuit 23 to assure that the flip-flop 25 has been reset.

Having thus described in detail a preferred embodiment of the invention, persons skilled in the art will be able to modify certain of the circuitry which has been illustrated and to substitute equivalent elements for those disclosed, while continuing to practice the principle of the invention, and it is, therefore, intended that all such modifications and substitutions be covered as they are embraced within the spirit and scope of the appended claims.

We claim:

1. In electronic timing apparatus including electronic circuit calculator means capable of executing addition and subtraction arithmetic functions; keyboard means for selectively entering digital data to said calculator means; visual display means for displaying the output data of said calculator means; oscillator circuit means for generating a train of pulses of predetermined periods, the improvement comprising: starting circuit means including first switch means and latching circuit means actuated by said first switch means for generating a start signal; sequencing circuit means responsive to said start signal for generating first, second and third signals in time sequence; second switching circuit means responsive to said first signal for effecting an ADD function in said calculator for entering preset time signals into said calculator means through said keyboard means; said calculator means responsive to said second switching circuit means for storing said preset time signals; said second switching circuit means being responsive to said second signal for establishing a modifier value signal in said calculator means; first gate circuit means responsive to said third signal for enabling the passage of output train of pulses of said oscillator circuit means to said second switching circuit means for performing repetitive arithmetic functions in said calculator means and sequentially incrementing or decrementing the contents of said calculator means by said modifier value, whereby the data accumulated in said calculator means and displayed on said display means is modified in response to the pulses occurring in said train of pulses from said oscillator circuit means.

2. The system of claim 1 wherein said sequencing circuit means includes a first channel including second gate circuit means for generating said first signal of predetermined width immediately in response to an output signal of said latching circuit means; a second channel including third gate circuit means for generating said second signal for establishing said modifier value in said calculator means after said first signal has terminated, said second channel further including first delay circuit means for delaying said second signal until after termination of said first signal; and a third channel including said first gate circuit means having a signal lead receiving the output signal pulses of said oscillator circuit means and an ENABLE lead responsive to said START signal, said third channel further including second delay circuit means for delaying said START signal until after said second pulse has terminated to provide said third signal.

3. The system of claim 2 wherein each of said first and second delay circuit means comprises a resistor-capacitor charging circuit, the time constant of which determines the amount of delay, said system further comprising unidirectional circuit means associated with said first and second delay circuits for discharging associated capacitors at a rate substantially less than the charging time therefor.

4. The system of claim 1 further comprising a mode switch receiving the output signal of said first gate circuit means for directing the output pulses of said oscillator circuit means selectively to cause said calculator means to effect an ADD function or a SUBTRACT function, the setting of said mode switch determining whether said calculator means will increment or decrement its contents.

5. The system of claim 1 further comprising a CLEAR switch actuatable by an operator for clearing the contents of said calculator means; and reset circuit means for generating a signal to reset said latching circuit means.

6. The apparatus of claim 1 further comprising sensing circuit means responsive to the presence of a signal representative of a minus sign in the tenths position of said display means for generating a control signal in response thereto; and audio signal means actuated by said control signal.

7. The apparatus of claim 6 further comprising circuit means for multiplexing the display of individual digits of said display means; said sensing circuit means further comprising circuit means responsive only to the display of said tenths digit by said calculator means for controlling said audio signal means to generate said audio signal only when said minus sign is present in said tenths position, said audio signal means receiving and being modulated by the output signal of said oscillator means.

8. The system of claim 1 wherein said latching circuit means comprises a flip-flop circuit having a first stage and a second stage, said first stage being triggerable by said first switch means, and further comprising time delay means for delaying and feeding back the output signals of said second stage to said first stage, whereby said flip-flop is rendered insensitive to contact bounce of said first switch means, and said first switch means is able to start or stop said system.

9. The apparatus of claim 1 further comprising voltage regulator means cooperating with said oscillator circuit means to generate a level power supply voltage beneath the supply voltage of the remainder of said circuitry to stabilize the period of said oscillator circuit means.

10. In electronic timing apparatus for selectively operating either in a timer mode or a stopclock mode including: calculator circuit means for receiving input data signals and generating output data signals; display means for visually displaying the contents of said calculator circuit means; keyboard means for selectively entering preset timing data into said calculator circuit means; the improvement comprising: a START/STOP swtich actuatable by an operator; latching circuit means triggerable by actuation of said START/STOP swtich for generating a SET and a RESET signal alternately; sequencing circuit means responsive to said SET signal for generating, sequential first, second and third signals; first circuit means responsive to said first signal for actuating an arithmetic function in said calculator means whereby input data entered by said keyboard means is stored in said calculator means; second circuit means responsive to said second signal for effecting the insertion of a modifier value in said calculator means; third circuit means including an AND gate for transmitting an input signal responsive to said third signal; and oscillator circuit feeding the signal input of said AND gate; and a mode switch actuatable by the operator for selectively coupling the output of said AND gate to said calculator means to effect either an addition or a subtraction function, whereby said contents of said calculator will be successively incremented or decremented by said modifier value and said system may be operated respectively either as a stopclock or a preset timer.

11. The system of claim 10 wherein said display means comprises a plurality of light-emitting diode elements and including a tenths position and a hundredths position, said oscillator circuit generating 100 pulses per minute, whereby each pulse changes the hundredths position by 1, said system further comprising sensing circuit means responsive to the presence of a minus sign in said tenths position for gating the output of said calculator circuit means to selectively generate an audio signal in response thereto.

12. The apparatus of claim 11 wherein said calculator circuit means has a plurality of digit output lines multiplexed to actuate selectively and sequentially the elements of said display means, said system further comprising circuit means responsive to only one of said digit output lines of said calculator circuit means for generating an audio signal, and being modulated by the signal of said oscillator means to thereby generate an intermittent audio signal.

13. In electronic timing apparatus including electronic calculator means capable of executing an addition function; visual display means for displaying the output data of said calculator means; oscillator circuit means for generating a train of periodic pulses, the improvement comprising: starting circuit for generating a SET signal and including a switch and a latching circuit triggerable by actuating said switch between a set and a reset state; and sequencing circuit means responsive to the SET signal of said latching circuit for generating first and second signals sequentially; first circuit means responsive to said first signal for establishing an incremental value in said calculator means; and second circuit means responsive to said second signal for enabling the passage of the output train of pulses of said oscillator circuit means to said calculator means for repetitive arithmetic functions, thereby to sequentially modify the contents of said calculator means by said incremental value, whereby a signal representative of lapsed time is accumulated in said calculator means and displayed on said display means modified by said pulses from said oscillator circuit means.

14. The system of claim 13 wherein said first circuit means comprises a first channel including a first gate for generating a pulse of predetermined width in response to said set signal of said latching circuit; and said second circuit means comprises a second channel including a second gate having a signal lead receiving the output signal pulses of said oscillator circuit and a signal lead responsive to the output signal of said latching circuit and further including delay circuit means receiving said SET signal for delaying the same to prevent said train of pulses from being gated through said second gate until after first signal has terminated.

15. The system of claim 14 further comprising a CLEAR switch means actuatable by an operator for clearing the contents of said calculator means and for resetting said latching circuit.

* * * * *